United States Patent [19]

Vicard

[11] 4,390,426

[45] Jun. 28, 1983

[54] CENTRIFUGAL SEPARATORS OF THE CYCLONE TYPE

[75] Inventor: Pierre G. Vicard, Lyons, France

[73] Assignee: Societe Lab, Lyons, France

[21] Appl. No.: 381,981

[22] Filed: May 25, 1982

Related U.S. Application Data

[63] Continuation of Ser. No. 203,186, Nov. 3, 1980, abandoned.

[30] Foreign Application Priority Data

Nov. 8, 1979 [FR] France ..... 79 28023

[51] Int. Cl.[3] ..... B03C 3/14; B03C 3/36; B03C 5/02

[52] U.S. Cl. ..... 210/243; 55/127; 55/146; 55/416; 55/449; 55/451; 55/457; 210/512.1

[58] Field of Search ..... 55/127, 416, 449, 451, 55/454, 457, 146; 210/243, 512.1

[56] References Cited

U.S. PATENT DOCUMENTS

| | | | |
|---|---|---|---|
| 2,201,301 | 5/1940 | Richardson | 55/397 |
| 2,322,414 | 6/1943 | Bowen | 55/416 X |
| 2,393,112 | 1/1946 | Lincoln | 55/416 X |
| 2,667,942 | 2/1954 | Wintermute | 55/127 |
| 3,478,494 | 11/1969 | Lustenader et al. | 55/127 |
| 3,670,479 | 6/1972 | Tomlinson | 55/416 |
| 4,008,059 | 2/1977 | Monson et al. | 55/396 |
| 4,010,011 | 3/1977 | Reif | 55/127 |
| 4,127,396 | 11/1978 | Tortorici et al. | 55/457 X |

FOREIGN PATENT DOCUMENTS

| | | | |
|---|---|---|---|
| 1069071 | 7/1954 | France . | |
| 61665 | 5/1955 | France . | |
| 2338086 | 8/1977 | France . | |
| 680297 | 10/1952 | United Kingdom | 210/512.1 |

*Primary Examiner*—Kathleen J. Prunner
*Attorney, Agent, or Firm*—Dowell & Dowell

[57] ABSTRACT

The present invention relates to improvements in centrifugal separators of the cyclone type, in which the liquid or gaseous fluid to be purified passes through an inlet blading which is shaped so as to cause the fluid to whirl rapidly in so-called irrotational flow with uniform longitudinal lamellar components, around a high voltage electrode. An outlet device firstly comprises a convergent portion which partly converts the energy of whirling into energy of longitudinal translation, then a blading which completes the conversion, and finally a divergent portion in which the excess of dynamic energy of flow is converted into static pressure in order to recover as much as possible of the whirling energy applied to the fluid upstream of the inlet of the cyclone device. The separated particles are evacuated through a tangential outlet. The invention is more particularly applicable to the purification of fluids.

1 Claim, 2 Drawing Figures

CENTRIFUGAL SEPARATORS OF THE CYCLONE TYPE

This application is a continuation of application Ser. No. 203,186, filed Nov. 3, 1980 now abandoned.

The present invention relates to centrifugal separators of the cyclone type adapted to extract from a liquid or gaseous fluid the solid or liquid particles suspended therein. It relates more particularly to the case of apparatus of the type in question having substantially horizontal axis in which the fluid to be treated flows longitudinally, entering through one end to emerge through the other. Such cyclones generally comprise an inlet blading adapted to impart to the fluid a rapid helical whirl, an annular outlet for the separated product and a central outlet for purified fluid made in the form of a simple axial tube whose diameter is slightly smaller than that of the body of the apparatus.

Such cyclones have the drawback of consuming a considerable amount of energy and therefore of requiring the presence of relatively high-power pumps or fans. Firstly, to impart rapid helical whirl, corresponding kinetic energy must be imparted thereto, this involving a considerable static and/or dynamic pressure upstream of the inlet blading. This energy is virtually lost in the outlet pipe in which the fluid whirls until its motion disappears under the effect of frictions and the like. Finally, the whirl produced by the inlet blading is not perfect, this resulting in irregular eddies forming in the apparatus, which often extend to the outlet, thus hindering the regular helical whirl of the mass of fluid and reducing the efficiency of separation. In addition, these irregularities in whirl cause considerable wear of the walls which becomes absolutely intolerable as soon as the tangential speed is to be increased in order to enhance the separator effect.

It is an object of the present invention to remedy the above-mentioned drawbacks and to provide a cyclone of the type in question which has a highly efficient separator effect and which requires only relatively reduced power for functioning thereof.

It is a further object of the invention to increase this efficiency by combining the intense centrifugal field created inside the cyclone with an electrostatic field maintained by an ionising or polarising axial electrode.

The apparatus of the invention is of the type comprising a cyclone in which the fluid to be treated whirls with axial displacement and which is provided, for causing the fluid to whirl, with an inlet device constituted by blades carried by a central core and disposed to impart whirling motion to the fluid passing therethrough. The invention is characterised in that these blades are, in cross section (perpendicular to the radius), shaped so that the spaces separating them are in the form of trapezoids with parallel inner and outer sides and concave curved non-parallel sides with a view to ensuring the irrotational lamellar flow having a uniform longitudinal speed component for all the annular layers of the fluid inside the body of the cyclone.

According to a further feature of the invention, rectifier means are provided at the outlet of the cyclone to remove the whirl from the fluid flow leaving the cyclone, the rectifier means comprising in succession:

a convergent stage which increases to a considerable extent the longitudinal speed of the various annular layers of the fluid by already effecting a partial conversion of the tangential speed into a longitudinal speed, a stage of complete conversion of the tangential speed into uniform longitudinal speed by means of blades surrounding a streamlined core body, this second stage being of constant, or preferably decreasing section (convergent effect); and a divergent stage with small angle of cone adapted to convert the high dynamic pressure of the fluid which leaves the preceding stage, into static pressure which thereby achieves substantial recovery of the energy of rotation of this fluid in the apparatus.

According to the invention, an axial electrode is also provided, which is made to pass through the streamlined core body of the second stage of the rectifier means (this body being, of course, made of insulating material). The electrode is engaged in another insulating body disposed along the axis of the rotating means associated with the inlet of the cyclone, the current being conducted to this electrode through its end located downstream of the outlet of this cyclone.

The invention will be more readily understood on reading the following description with reference to the accompanying drawings, in which.

Figure 1:
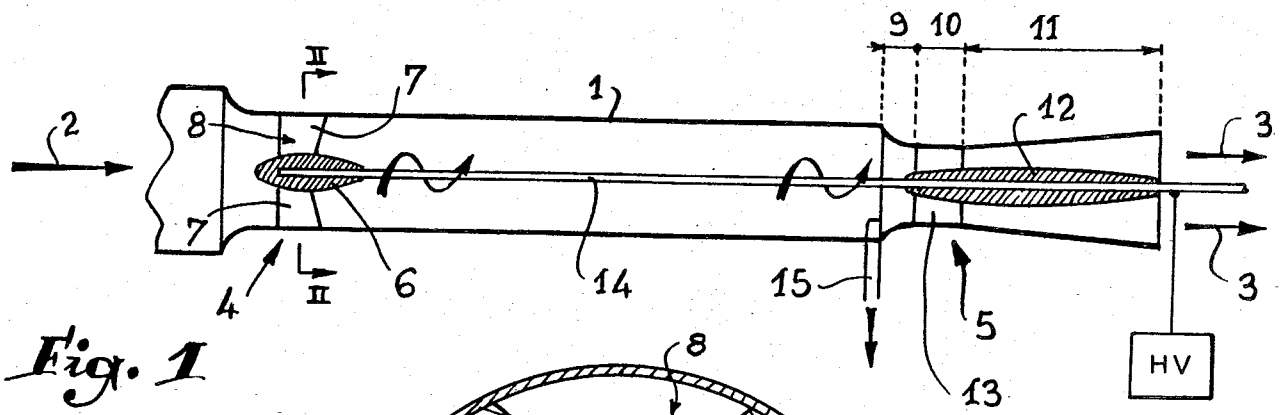
FIG. 1 is a schematic general longitudinal section of a cyclone according to the invention.

Referring now to the drawings, the horizontal-axis cyclone shown in FIG. 1 conventionally comprises a cylindrical body 1 through which the liquid or gaseous fluid to be treated passes longitudinally from end to end, namely from left to right in the drawing, as indicated by arrows 2 and 3. At the inlet is a device 4 for imparting whirl to the fluid around the geometrical axis of the body 1, whilst at the outlet another device 5 rectifies the flow to remove the whirling motion and recover the kinetic energy which corresponds to the tangential speed of whirl inside the body.

Figure 2:
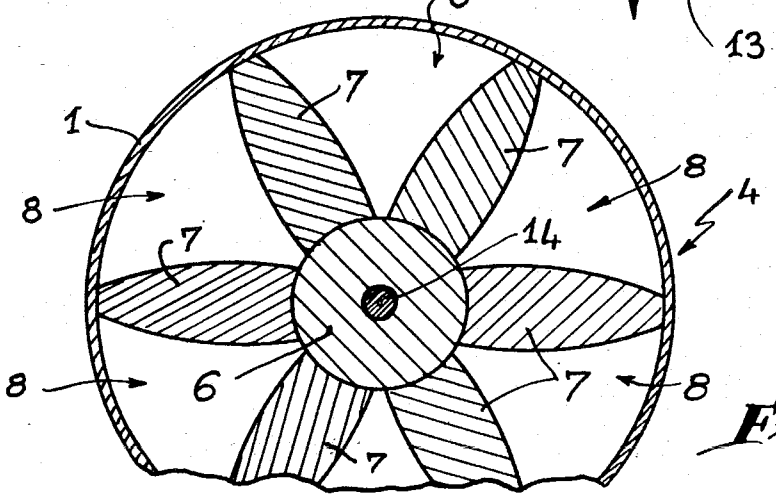
FIG. 2 is a transverse section thereof, on a larger scale, along line II—II of FIG. 1.

According to the invention, the inlet device 4 is arranged so that the fluid rotates in the body 1 in a so-called irrotational flow wherein the tangential speed is inversely proportional to the radius, and so that the longitudinal speed component of the various annular whirling lamellar layers is the same. In the embodiment shown (cf. FIG. 2), the device 4 comprises in known manner a suitably streamlined central core 6 and streamlined blades 7 mounted thereon for placing the fluid in rotation, similar means being well known in the prior art for rotating a column of fluid as shown in FIG. 1 of U.S. Pat. No. 4,010,011 to Reif. However, these blades are appreciably thick so as to enable the intermediate spaces 8 which they define to be shaped in transverse cross section as shown. In fact, to produce the irrotational flow with substantially uniform longitudinal speed component over the whole cross section, said spaces must be generally in the form of a trapezoid whose non-parallel boundaries are preferably concave. Of course, to avoid the formation of eddies, the blades 7 taper upstream and downstream so as to comprise a streamlined cross section having a rounded edge at the front and a substantially sharp edge at the rear, in the manner known for example in aircraft wings.

The outlet device 5 comprises three successive stages 9,10 and 11. The upstream stage 9 is convergent. The intermediate stage 10 is provided with a streamlined central core 12 and with sectioned rectifying blades 13. This intermediate stage may be cylindrical, but it is preferably provided to be slightly convergent. The downstream stage 11 is divergent with a small angle of cone. It will be noted that the assembly 9-10-11 represents a venturi in the neck of which rectifying blades 13 have been disposed. As shown, the core 12, streamlined like the inlet core 6, but of greater length, may extend upstream over a fraction of the length of the stage 9 and downstream to the opening of stage 11.

The cyclone which has been shown further comprises an axial electrode 14 supported by the cores 6 and 12 made of insulating material at least in their central part. The upstream end of this electrode remains inside the core 6, but its downstream end passes, on the contrary, beyond the opening of the stage 11, to be connected to a high voltage current supply generator HV. The electrode 14 passes completely through the core 12 of the outlet device and therebeyond, and it is connected to said supply generator HV downstream of this outlet device in a zone where the particles have been removed from the fluid.

The cyclone comprises a tangential peripheral outlet 15 for the separated divided product. This outlet, which may be equipped with a valve, lock or other known device (not shown), is located immediately in front of the upstream stage 9 of the outlet device 5. Furthermore, it will be noted that it is possible to arrange in known manner a plurality of cyclones in parallel inside the same housing, in which case the outlets of said cyclones would open out directly into the interior of the housing.

When the apparatus is functioning, the fluid is immediately placed in irrotational helical flow in uniform manner, due to the inlet device 4, and as the longitudinal speed components of all the layers are the same, its rotation continues uniformly along the whole length of the body without any formation of eddies which would cause losses of energy. When the fluid passes through the convergent stage 9 of the outlet device, its longitudinal speed component rises considerably and the pitch of the helical path along which the various lamellar streams pass consequently increases to the same extent, this corresponding to the beginning of conversion of the tangential speed into longitudinal linear speed. This conversion is completed in stage 10 due to the presence of the blades 13 which rectify the flow to remove its whirl without considerable loss of energy. The divergent stage 11 recovers the kinetic energy, i.e. converts the dynamic energy into static pressure. Finally, the fluid at the outlet is at a static pressure only slightly lower than the inlet pressure.

It should be noted that current may be conducted to the axial electrode 14 through the downstream end thereof, i.e. in a zone where the fluid is already purified and where the particles that it originally contained in suspension cannot provoke either leakages of current by creeping or the initiating of short circuits.

The preceding description has of course been given only by way of example and in no way limits the field of the invention, or the replacement of the details of execution described by any other equivalents not departing from the scope thereof. Thus, the upstream tip of the central core 12 of the outlet device 5 may be located more or less in front, and even to the rear, of the convergent stage 9, the rectifying blades 13 themselves extending more or less over the upstream part of this core, possibly up to the tip thereof. Furthermore, the invention relates not only to the cyclones of the above-mentioned type, but also to the process which they carry out. In addition, when the present description refers to particles, they may equally well be liquid or solid (for example, the case of gases laden with fine liquid droplets).

What is claimed is:

1. A cyclone separator for the centrifugal separation of solid or liquid particles suspended in a fluid wherein the fluid is whirled about an axis and displaced therealong, the separator comprising:

a tubular body surrounding said axis and having an upstream inlet end and a downstream outlet end;

an inlet device at the inlet end of the body and comprising a first insulating core surrounding said axis and supporting inlet blades extending between said core and said tubular body, the blades being disposed to impart whirling motion to fluid flowing axially through said body, said inlet blades as viewed in transverse cross section taken normal to said axis being shaped to provide on each blade convex side walls mutually converging from the core toward the body and leaving between the blades trapezoidal spaces having parallel inner and outer boundaries and concave non-parallel side boundaries which diverge outwardly from the core toward the body;

an outlet device at the outlet end of the body and comprising an upstream convergent stage, an intermediate stage coupled to the upstream stage, a divergent downstream stage coupled to the intermediate stage, a second insulating core surrounding the axis within the outlet device, and outlet blades extending from said core to said tubular body in said intermediate stage and operative to rectify the flow of the fluid to remove its whirling motion about said axis;

an electrode extending along said axis and being supported by said cores, and having an end extending beyond the outlet device into a zone where the particles have been removed and the fluid is no longer whirling;

a voltage supply generator connected to said extended end of the electrode; and a lateral discharge extending from the tubular body adjacent to the upstream end of said outlet device and operative to discharge separated particles.

* * * * *